US007253709B1

(12) United States Patent
Chang et al.

(10) Patent No.: US 7,253,709 B1
(45) Date of Patent: Aug. 7, 2007

(54) RF MEMS SWITCH WITH SPRING-LOADED LATCHING MECHANISM

(75) Inventors: David T. Chang, Calabasas, CA (US); James H. Schaffner, Chatsworth, CA (US); Tsung-Yuan Hsu, Westlake Village, CA (US); Adele E. Schmitz, Newbury Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 207 days.

(21) Appl. No.: 10/961,732

(22) Filed: Oct. 7, 2004

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,121,089 | A | 6/1992 | Larson | 333/107 |
| 5,351,412 | A | 10/1994 | Furuhata et al. | 33/568 |
| 5,418,418 | A | 5/1995 | Hirano et al. | 310/328 |
| 6,046,659 | A | 4/2000 | Loo et al. | 333/262 |
| 6,331,257 | B1 | 12/2001 | Loo et al. | 216/13 |
| 6,496,612 | B1 | 12/2002 | Ruan et al. | 385/18 |
| 6,509,670 | B2 * | 1/2003 | Jeong et al. | 310/309 |
| 6,798,315 | B2 * | 9/2004 | Schaefer | 333/105 |
| 7,138,893 | B2 * | 11/2006 | Nakanishi et al. | 335/78 |
| 2004/0164825 | A1 * | 8/2004 | Volant et al. | 335/78 |

OTHER PUBLICATIONS

Harness, T., et al., "Characteristic Modes of Electrostatic Comb-Drive X-Y Microactuators," *J. Micromech. Microeng.*, vol. 9, 1-8 (1999).

Hyman, D., et al., "GaAs-Compatible Surface-Micromachined RF MEMS Switches," *Electronics Letters*, vol. 35, No. 3, pp. 1-2 (Feb. 4, 1999).

Sun, Xi-Qing, et al., "A Bistable Microrelay Based on Two-Segment Multimorph Cantilever Actuators," *The Eleventh Annual International Workshop on Micro-electro Mechanical Systems*, pp. 154-159 (Jan. 25-29, 1998).

* cited by examiner

*Primary Examiner*—Elvin Enad
*Assistant Examiner*—Bernard Rojas
(74) *Attorney, Agent, or Firm*—Ladas & Parry

(57) ABSTRACT

Apparatus for a micro-electro-mechanical switch that provides for latching switching action. The switch has a cantilever arm disposed on a substrate that can be moved in orthogonal directions for latching and unlatching. To latch the switch, the cantilever arm is moved back by a comb-drive actuator and then pulled down by electrodes disposed on the substrate and the cantilever arm. The comb-drive actuator switch is then released and the cantilever arm moves forward to be captured by a dove-tail structure on the substrate. When the voltage to the electrodes on the substrate and the cantilever arm is removed, the cantilever arm is held in place by the dove-tail structure. The switch is unlatched by actuating the comb-drive actuator to move the cantilever arm away from the dove-tail structure. The cantilever arm will then pop up once it is released from the dove-tail structure.

17 Claims, 6 Drawing Sheets

RF MEMS SWITCH WITH SPRING-LOADED LATCHING MECHANISM

BACKGROUND

1. Technical Field

The present disclosure relates generally to switches. More particularly, this disclosure relates to microfabricated electromechanical switches having a spring-loaded latching mechanism.

2. Description of Related Art

Switch networks are found in many systems application. For example, in satellite systems, switch networks are essential for routing matrices and redundancy systems. Future satellite systems will not only require larger switch routing networks, but also increased functionality for network-centric operations. These new capabilities will includes spacecraft reconfiguration for beam switching, beam shaping, and frequency agility. Thus, it is expected that satellites will require an increasing number of switches in their payloads.

In many cases, these switches need to be latching, that is, once they are actuated they will remain in a desired state even after the actuation energy source is removed. Some of the applications where latching switches are important are ultra-reliable networks where power interruptions could create a problem, such as satellite or Unmanned Air Vehicles, or networks where supplied power is limited, like in small mobile platforms that run on batteries. Current latching switch technology typically relies on magnetic or motor drives to change switch states. These switches, typically fabricated using coaxial conductors or metallic waveguide, generally work very well. However, most of the applications listed above would benefit from size and weight reduction since the mechanical latching switches currently in use tend to be larger and heavier than desired. Semiconductor switches, such as made using PIN diodes and FET switches, are small, but they typically cannot latch in multiple states without a constant energy source.

Radio Frequency (RF) Micro Electro-Mechanical System (MEMS) switches are known in the art to have small size and weight and are also known to provide desirable performance in the radio frequency and microwave spectrums. Several types of MEMS switches are well-known in the art. For example, U.S. Pat. No. 5,121,089 issued Jun. 9, 1992 to Larson discloses a microwave MEMS switch. The Larson MEMS switch utilizes an armature design. One end of a metal armature is affixed to an output line, and the other end of the armature rests above an input line. The armature is electrically isolated from the input line when the switch is in an open position. When a voltage is applied to an electrode below the armature, the armature is pulled downward and contacts the input line. This creates a conducting path between the input line and the output line through the metal armature. This switch requires a constant voltage to maintain the switch in a closed state.

As another example, U.S. Pat. No. 6,046,659 of Loo et al. discloses methods for the design and fabrication of non-latching single pole single throw MEMS switches. U.S. Pat. No. 6,046,659 is incorporated herein by reference in its entirety. FIG. 1 shows a top view of a MEMS switch 10 according to Loo et al, which provides single pole single throw switching between an input line 20 and an output line 18.

FIGS. 2A and 2B are side-elevational views of the MEMS switch 10. FIG. 2A shows the switch 10 in the open position and FIG. 2B shows the switch 10 in the closed position. Beam structural material 26 is connected to a substrate 14 through a fixed anchor via 32. A suspended armature bias electrode 30 is nested within the structural material 26 and electrically accessed through a bias line 38 at an armature bias pad 34. A conducting transmission line 28 is at the free end of the beam structural layer 26 and is electrically isolated from the suspended armature bias electrode 30 by the dielectric structural layer 26. Contact dimples 24 of the transmission line 28 extend through and below the structural layer 26 and define the areas of metal contact to the input and output lines 20 and 18, respectively. A substrate bias electrode 22 is below a suspended armature bias electrode 30 on the surface of the substrate 14. When a voltage is applied between the suspended armature bias electrode 30 and the substrate bias electrode 22, an electrostatic attractive force will pull the suspended armature bias electrode 30 as well as the attached armature 16 towards the substrate bias electrode 22. The contact dimples 24 touch the input line 20 and the output line 18, so the conducting transmission line 28 bridges the gap between the input line 20 and the output line 18, thereby closing the MEM switch.

Loo et al. generally describe a surface micromachined device. That is, layers are deposited on top of a substrate, and then one or more of the layers is etched away to release the moving parts of the switch 10. As described in Loo et al., the parts of the switch generally comprise gold (or gold alloys) for the switch contacts, silicon dioxide for the one or more layers etched away (i.e., the sacrificial layers), and silicon nitride for the beam structural layer. However, the Loo switch generally requires a voltage to be applied to keep the switch in a closed state.

An example of a latching micro switch is described in U.S. Pat. No. 6,496,612 issued Dec. 17, 2002 to Ruan et al. Ruan et al. describe a switch having a cantilever to switch between an open state and a closed state. To operate as a latching switch, a permanent magnet is used to maintain the cantilever in an open state or a closed state. However, the use of a permanent magnet may result in a switch that is bigger and/or heavier than desired. Further, the placement of the permanent magnet further complicates the manufacture of the switch, increasing the cost of the switch.

Another example of a latching switch is described by Xi-Qing Sun, K. R. Farmer and W. N. Carr in "A Bistable Micro Relay Based on Two-Segment Multimorph Cantilever Actuators," The Eleventh Annual International Workshop on Micro-electro Mechanical Systems, 1998, MEMS 98 Proceedings, Jan. 25-29, 1998, pp. 154-159. Sun et al. describe a latching switch mechanism that uses two metals to create stresses in opposite directions along a cantilever beam. RF contacts can be moved by controlling the stress on the two segments electrostatically to lengthen or shorten the length of the cantilever along the substrate so that the contact can be moved from one RF line to another. The fabrication of the switch disclosed by Sun et al. may be complicated since two different metals are required. Further, the latching force is on a direction that may ultimately pull the metal bar from the cantilever.

Therefore, there is a need in the art for small, lightweight latching switch that does not require a constantly applied external voltage or magnetic source to stay latched in a selected state.

SUMMARY

Embodiments of the present invention provide for a method and apparatus for switching that is latchable. An embodiment of the present invention comprises a RF MEMS metal contact electrostatically actuated latching switch. According to embodiments of the present invention, a cantilever arm is provided that can be moved into orthogonal directions for latching and unlatching. That is, in one orientation, the cantilever arm may be moved in both a horizontal direction and a vertical direction.

Embodiments of the present invention may have a latching structure that essentially comprises a metalized angular mortise and tenon structure. The mortise and tenon structure may be provided by etching a substrate to provide a dovetail structure at the edges of the etched portions of the substrate. The etched edge of the substrate then forms the mortise. The end of the cantilever arm is fabricated to form the tenon. In a latched state, the tenon portion of the cantilever arm fits within the mortise portion of the substrate.

According to some embodiments of the present invention, movement in orthogonal directions may be provided by a combined comb-drive actuator structure and parallel plate actuator structure to move a cantilever arm prior to latching or unlatching. The comb-drive actuator structure provides the capability to move the cantilever arm parallel to the substrate surface. The parallel plate actuator structure provides the capability to move the cantilever arm vertically in a manner similar to that described above for the Loo switch.

BRIEF DESCRIPTION OF THE DRAWINGS

These and other features and advantages will become more apparent from a detailed consideration of the invention when taken in conjunction with the drawings described below. However, this invention may be embodied in many different forms and should not be construed as limited to the embodiments depicted in the drawings or described below. Further, the dimensions of certain elements shown in the accompanying drawings may be exaggerated to more clearly show details. The present invention should not be construed as being limited to the dimensional relations shown in the drawings, nor should the individual elements shown in the drawings be construed to be limited to the dimensions shown.

DETAILED DESCRIPTION

It should be appreciated that the particular embodiments shown and described herein are examples of the invention and are not intended to otherwise limit the scope of the present invention in any way. Indeed, for the sake of brevity, conventional electronics, manufacturing, MEMS technologies and other functional aspects of the systems (and components of the individual operating components of the systems) may not be described in detail herein. Furthermore, for purposes of brevity, embodiments of the invention are frequently described herein as pertaining to a micro electromechanical switch for use in electrical or electronic systems. It should be appreciated that many other manufacturing techniques could be used to create the embodiments described herein. Further, the embodiments according to the present invention would be suitable for application in electrical systems, optical systems, consumer electronics, industrial electronics, wireless systems, space applications, or any other application. Moreover, it should be understood that the spatial descriptions (e.g. "above", "below", up "down", etc.) made herein are for purposes of illustration only, and that embodiments of the present invention may be spatially arranged in any orientation or manner.

Figure 1:
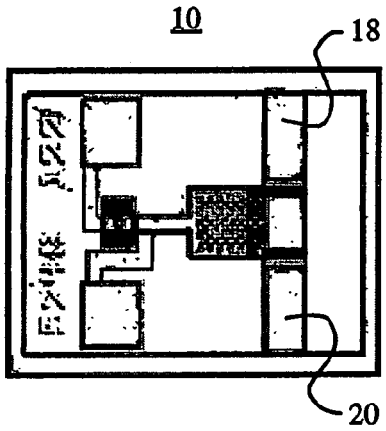
FIG. 1 (Prior Art)
FIG. 1 (prior art) is a top view of a prior art RF MEMS switches.
Figure 2A:
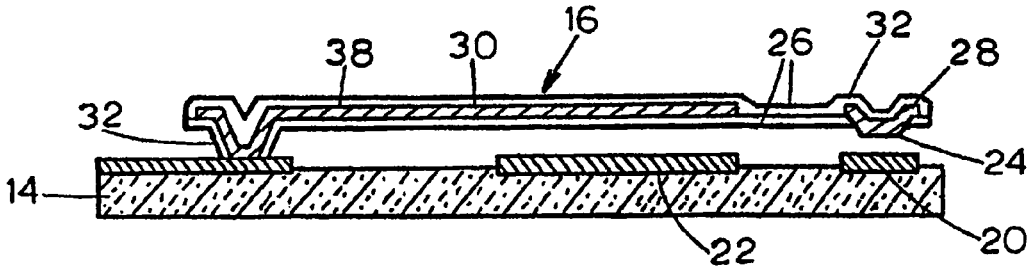
FIG. 2A (Prior Art)
FIG. 2A (prior art) shows a cross-sectional view of the switch in FIG. 1 in an open position.
Figure 2B:
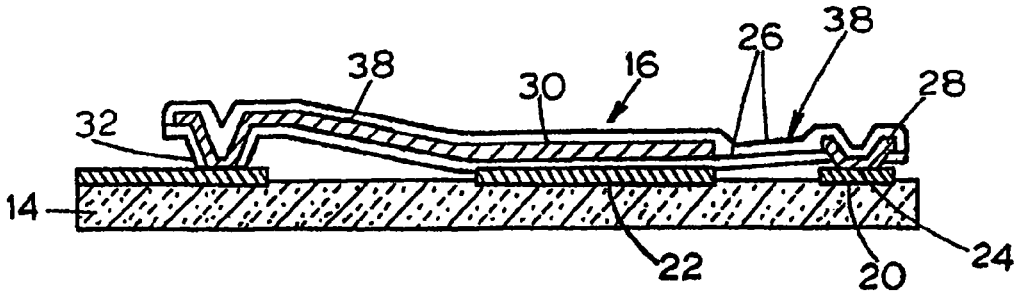
FIG. 2B (Prior Art)
FIG. 2B (prior art) shows a cross-sectional view of the switch in FIG. 1 in a closed position.
Figure 3:
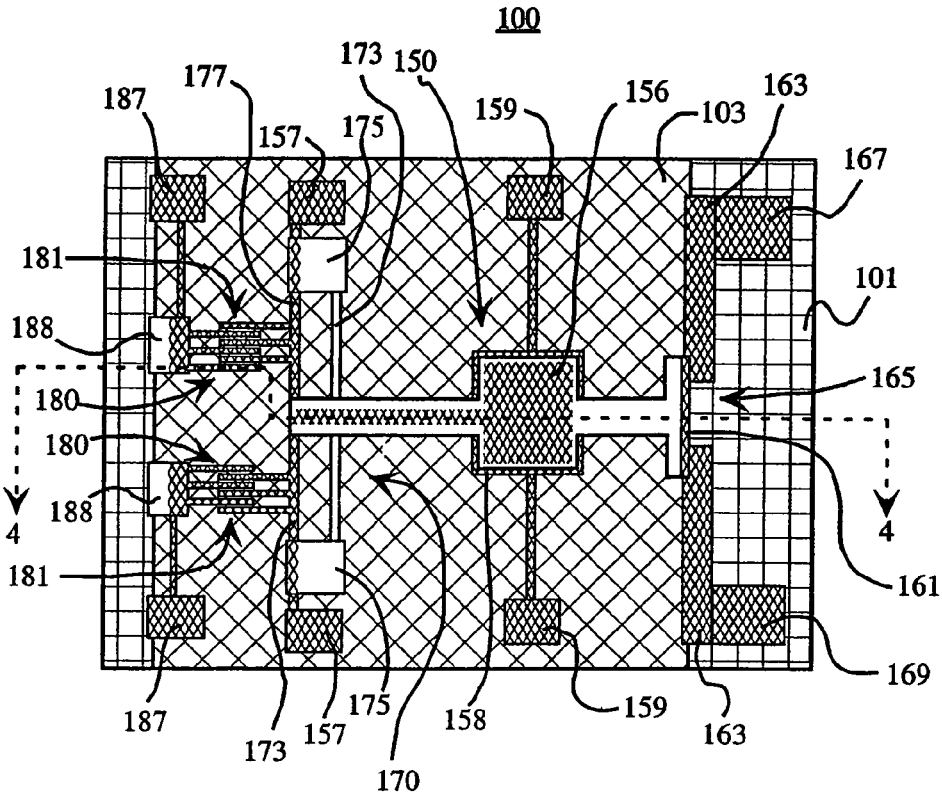
FIG. 3 shows a top view of a switch according to an embodiment of the present invention.
Figure 4:
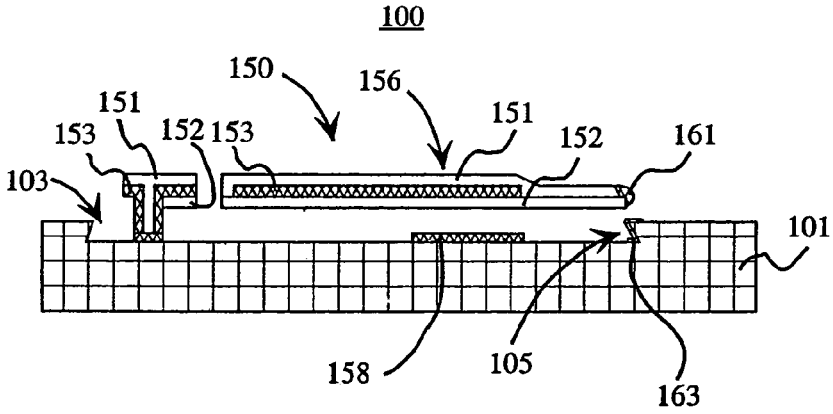
FIG. 4 shows a side view of the switch shown in FIG. 3.

A top view of an embodiment of a switch 100 according to the present invention is shown in FIG. 3. FIG. 4 presents a side view of the switch 100 along the center line 4. The switch 100 comprises a switch beam 150 disposed on a substrate 101. The substrate 101 preferably comprises semi-insulating GaAs with a {100} crystallographic orientation. A portion of the substrate 101 is etched away to provide an etched region 103 in the substrate 101. If the substrate 101 comprises GaAs, the substrate is preferably etched away with an acidic $H_2O_2$ solution. A property of this etching solution on the preferred orientation of GaAs is that the wall of the etched GaAs is undercut from the surface to provide a dovetail structure 105 as shown in FIG. 4.

The switch beam 150 is preferably disposed above the etched region 103. For ease of understanding, the switch 100 can be considered as comprising four parts. The first portion consists of the switch beam 150, a beam electrode 156 and a substrate electrode 158. The switch beam 150 preferably comprises at least two structural layers 151, 152 and one or more metal layers 153. The at least two structural layers 151, 152 preferably comprise silicon nitride and the one or more metal layers 153 preferably comprise gold, each 1-2 μm in width. The structural layers 151, 152 may comprise dielectric materials other than silicon nitride. However, such other dielectric materials should be easily deposited and patterned and have good resistance to the final release etch of the sacrificial layer, discussed below. Silicon nitride is preferred, since it is a material that is commonly used in the semiconductor industry. Materials other then gold, such as aluminum, may be used for the one or more metal layers 153.

As shown in FIG. 4, the one or more metal layers 153 are configured to provide the beam electrode 156 on or in the switch beam 150. FIG. 4 shows two structural layers 151, 152 and a metal layer 153 sandwiched between them. It is preferred that the metal layer 153 be disposed between the upper structural layer 151 and the lower structural layer 152, so that the structure is more symmetric and less prone to stress caused by thermal expansion mismatch. However, if a thick structure is required, more structural layers 151, 152 and/or metal layers 153 can be deposited. Further, alternative embodiments may have only the upper structural layer 151 or the lower structural layer 152.

The beam electrode 156 and the substrate electrode 158 are used to create an electrostatic field to pull the switch beam down 150. The actuation voltage may be applied to the substrate electrode through substrate electrode actuation pads 159. The beam electrode 156 may be connected through the switch beam 150 and a spring section 160 (discussed below) to ground pads 157. Upon application of a voltage to the substrate electrode actuation pads 159, the beam electrode 156 will be attracted to the substrate electrode 158, causing the switch beam 150 to move towards the substrate 101.

The next part of the switch 100 is where the RF signal is switched. It includes the tip 161 of the switch beam 150, which comprises a conducting material. Preferably, the conducting material is gold. A metalized mortise 163 is disposed on the dovetail structure 105 formed by the etching of the substrate 101. The mortise 163 preferably comprises gold that is sputtered on and under the overhanging dovetail structure 105. Input 167 and output 169 RF lines are disposed on the substrate 101. The input 167 and output 169 RF lines may be sputtered down and then plated to the desired thickness. A gap 165 in the metalized mortise 163 separates the input 167 and output 169 RF lines. It is preferred that the tip 161 and mortise 163 comprise gold, but other metals or conducting materials that do not easily oxidize may also be used.

The third part of the switch 100 is a switch beam spring 170. The switch beam spring 170 comprises one or more cross beams 171, 173 attached to switch beam anchors 175. The switch beam anchors 175 comprise posts disposed on the substrate 101. In equilibrium, the spring beam 150 is disposed such that the tip 161 of the switch beam 150 extends beyond the mortise 163, as shown in FIG. 4. The switch beam spring 170 is preferably fabricated from the same structural layers 151 and metal layers 153 that the switch beam 150 is fabricated from. Therefore, the switch beam spring preferably comprises one or more layers of silicon nitride and one or more layers of gold. A metal line 177 is attached from ground actuation pads 157, along one of the cross beams 173, and to the metal layer 153 configured to provide the beam electrode 156.

The fourth part of the switch 100 is one or more comb-drive actuators 180 consisting of pairs of interdigitated fingers 181. The fingers 181 preferably comprise the same structural layers 151 and metal layers 153 that the switch beam 150 is fabricated from. One side of the comb-drive actuator 180 is anchored to the substrate 101 by comb actuator posts 188. One side of the interdigitated fingers 181 are electrically connected to comb-drive actuation electrode pads 187 through the comb actuator posts 188 by metal lines and vias. The other side of the interdigitated fingers 181 is attached to the switch beam spring 170. The other side of the interdigitated fingers 181 is electrically connected to the ground actuation pads 157 by the metal line 177.

Figure 5:
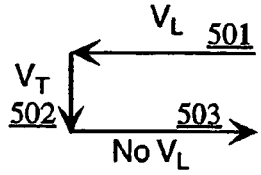
FIG. 5 illustrates the steps for latching the switch.

The steps for latching the switch 100 are described below and are also shown in FIG. 5. Assume the switch is in the equilibrium position shown in FIG. 4. As shown in FIG. 4, the tip 161 of the switch beam 150 is above the metalized mortise 163. First, a voltage $V_L$ is applied to the comb-drive actuator 180. The electrostatic force between the interdigitated fingers 181 pulls the switch beam spring 170 and switch beam 150 toward the comb actuator posts 188, as shown by the arrow 501 in FIG. 5. The switch is fabricated such that the application of voltage $V_L$ will result in the tip 161 of the switch beam 151 being pulled behind the metalized mortise 163. Then a voltage $V_T$ is applied between beam electrode 156 and the substrate electrode 158, which causes the switch beam 150 to be pulled down, as shown by arrow 502 in FIG. 5. The switch beam 150 should then rest against the substrate 101 and/or the substrate electrode 158. The comb-drive actuation voltage $V_L$ is then removed, and the switch beam spring 170 relaxes toward lateral equilibrium, as shown by arrow 503 in FIG. 5. It is prevented from reaching equilibrium when the tip 161 of the switch beam 150 hits the metalized mortise 163. The metal-metal contact of the tip 161 of the switch beam 150 and the metalized mortise 163 causes the RF lines 167, 169 to be electrically connected, hence the switch 100 is closed. The contact force of the switch beam 150 to the metalized mortise 163 is maintained even when the pull down voltage $V_T$ is removed, and the shape of the metalized mortise 163 keeps the switch 100 latched into position.

To unlatch the switch, the voltage $V_L$ is again applied to the comb-drive actuator 180. The tip 161 of the switch beam 150 will slide out of the metalized mortise 163, and, because the pull-down voltage is not present, the switch beam 150 will pop up. Removal of the comb-drive actuation voltage then puts the switch beam 150 back into equilibrium where it originated. The gap 165 between the RF lines 167, 169 is now not connected, so the switch 100 is open.

Figure 6:
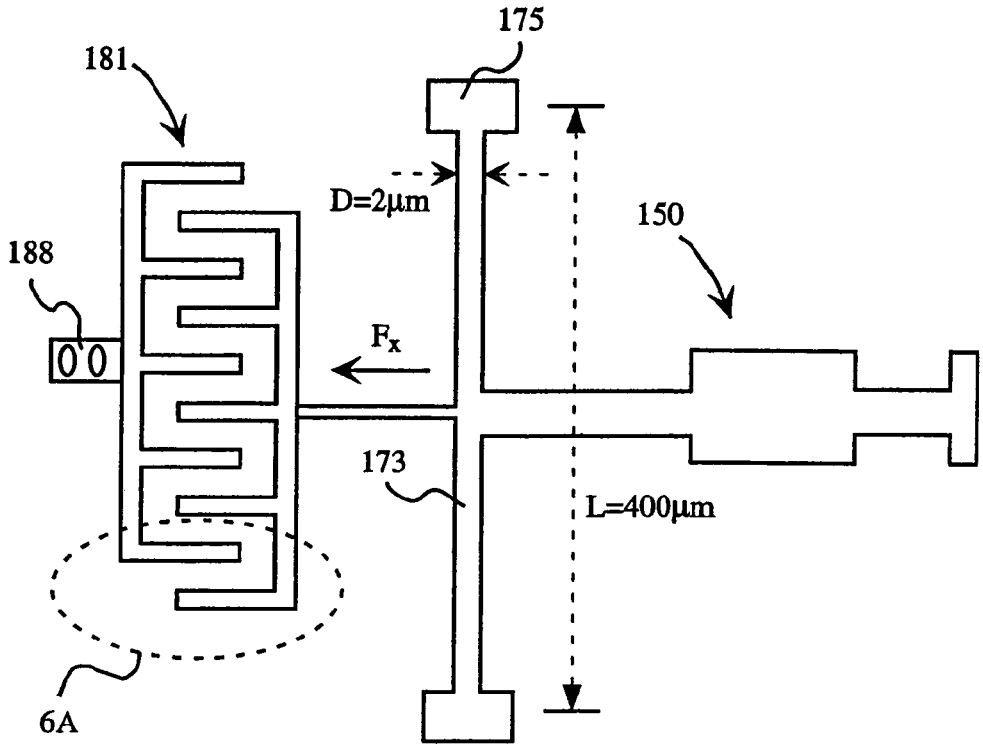
FIG. 6 illustrates the components used for calculating the force to laterally move the switch beam illustrated in FIGS. 4 and 5.
Figure 6A:
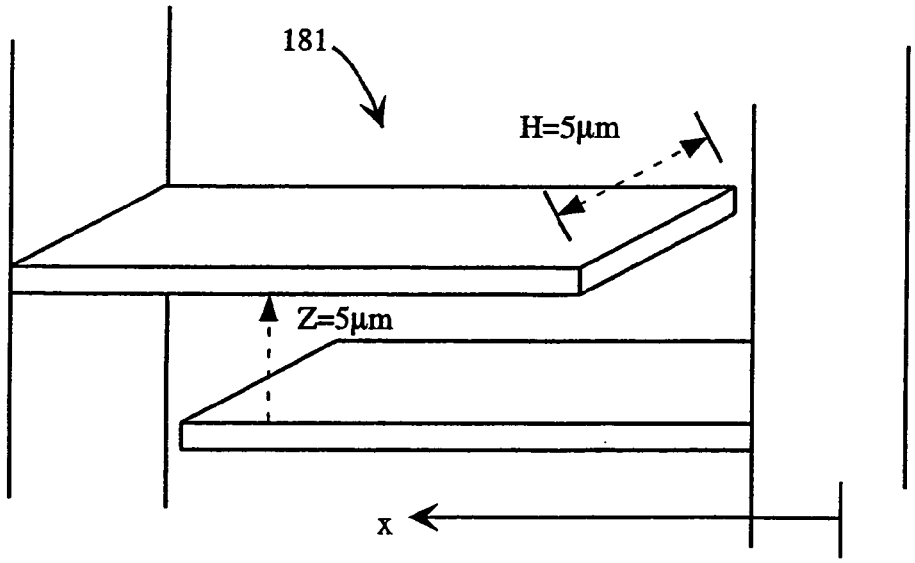
FIG. 6A shows a close-up view of a pair of the interdigitated fingers shown in FIG. 6.

The viability of this switch can be demonstrated by simple calculations. FIG. 6 illustrates the dimensions of various components used in the calculation of the comb-drive actuator force versus voltage. The calculations discussed below were made based on the use of a pair of interdigitated fingers 181, as shown in FIG. 6 and shown in a close-up and three-dimensional view in FIG. 6A. The height of each of the interdigitated fingers 181 (i.e. the width of each finger in a direction perpendicular to the surface of the substrate) is assumed to be 5 μm. MEMS switches using a trilayer of silicon nitride/gold/silicon nitride, such as the switch disclosed in U.S. Pat. No. 6,046,659, may have structures with thicknesses of 5 μm. Therefore, the assumption for a similar height for the interdigitated fingers 181 is considered reasonable. The gap between each interdigitated finger 181 is also assumed to be 5 μm.

The formula for the attractive force along the horizontal direction (i.e., the X direction shown in FIG. 5) is:

$$F_x = 0.5\,\varepsilon_0 V^2\left(\frac{H}{Z}\right)N$$

where H is the finger height and Z is the finger gap. V is the applied voltage and $\epsilon_0$ is the electric permittivity. N is the number of interdigitated finger surface pairs. If V=50 V and N=201, the force is $F_x=5.5\times10^{-5}$ Newtons. The number of interdigitated finger pairs used for the calculation is considered reasonable, since comb-drive actuators are known in the art that use more than this number.

The lateral displacement may also be determined by reviewing the geometry of the structure depicted in FIG. 5. The switch spring is assumed to be made of silicon nitride, with an elastic modulus of $3\times10^{11}$ Newtons/m$^2$. The nitride spring is 400 μm long and 2 μm wide. The lateral displacement may be found by the following equation $$x=0.625F_xL^3E^{-1}H^{-1}D^{-3}$$

where L is the length of the switch spring, D is the width of the switch spring, and H is the height of the switch spring (the same as for the comb-drive fingers). With the values given, it is found that x=18.2 μm, which should be more than enough to pull the end of the spring beam behind the mortise.

The processing of the switch is slightly modified from the current processing practice. The only fabrication differences from the current practice are 1) the first etching step to create the mortise and tenon by etching GaAs to the desired depth, and 2) the dimple etching step is not needed. The layer thickness may be varied depending upon the required latching forces and desired comb-drive actuator voltages. Additional layers of gold and nitride may also be added to build up the height of the comb-drive fingers to reduce the needed voltage. The use of sputtered gold insures that metal coats the edges of the mortise 163.

Figure 7A:
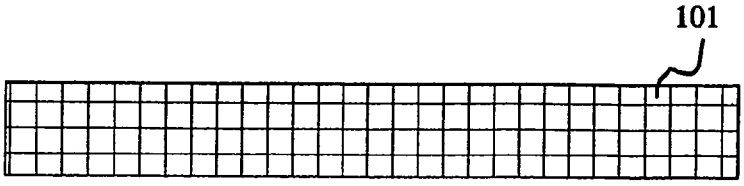
FIGS. 7A-7H show steps of a fabrication process for one embodiment according to the present invention.

FIGS. 7A-7H illustrate the manufacturing processes embodying the present invention used to fabricate the switch 100 of FIGS. 3 and 4. FIGS. 7A-7H present a profile of the switch taken along the section line 4-4 of FIG. 3. As shown in FIG. 7A, the process begins with a substrate 101. In a preferred embodiment, GaAs with a {100} crystallographic orientation is used as the substrate. Other materials may be used, however, such as InP, ceramics, quartz or silicon. The substrate is chosen primarily based on the technology of the circuitry the MEMS switch is to be connected to so that the MEMS switch and the circuit may be fabricated simultaneously. For example, InP can be used for low noise HEMT MMICS (high electron mobility transistor monolothic microwave integrated circuits) and GaAs is typically used for PHEMT (pseudomorphic HEMT) power MMICS.

Figure 7B:
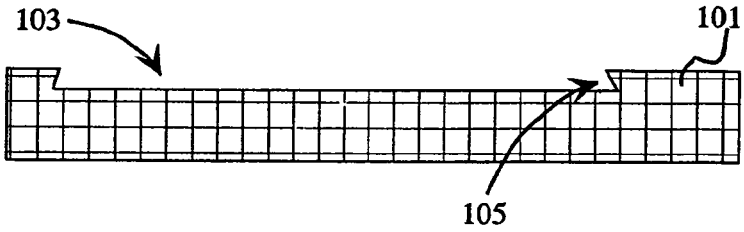

FIG. 7B shows a profile of the switch 101 after the etched region 103 is formed. The etch may be performed with acidic ($H_2SO_4$ or HCl)/hydrogen peroxide etch solutions. As indicated above, the substrate preferably comprises GaAs with a {100} crystallographic orientation, since this facilitates the formation of the dovetail structure 105 that facilitates latching.

Figure 7C:
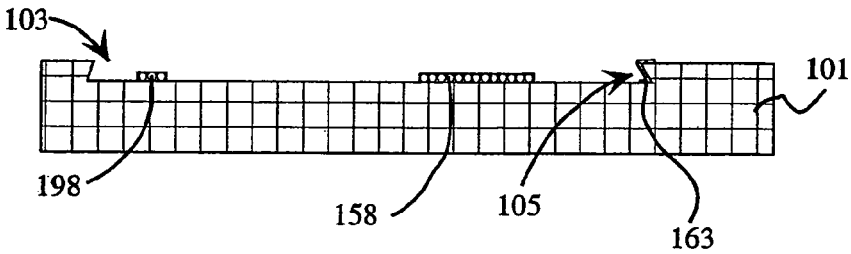

FIG. 7C shows the deposition of metal for the substrate electrode 158 and the metalized mortise 163. FIG. 7C also shows the deposition of metal on the substrate to form an electrical contact 198 between one side of the interdigitated fingers 181 and the comb-drive actuation electrode pads 187. The metal layer may be deposited lithographically using standard integrated circuit fabrication technology, such as resist lift-off or resist definition and metal etch. In the preferred embodiment, gold (Au) is used as the primary composition of the metal layer. Au is preferred in RF applications because of its low resistivity. In order to ensure the adhesion of the Au to the substrate, a 900 angstrom layer of gold germanium is deposited, followed by a 100 angstrom layer of nickel, and finally a 1500 angstrom layer of gold. The thin layer of gold germanium (AuGe) eutectic metal is deposited to ensure adhesion of the Au by alloying the AuGe into the semiconductor similar to a standard ohmic metal process for any III-V MESFET or HEMT.

Figure 7D:
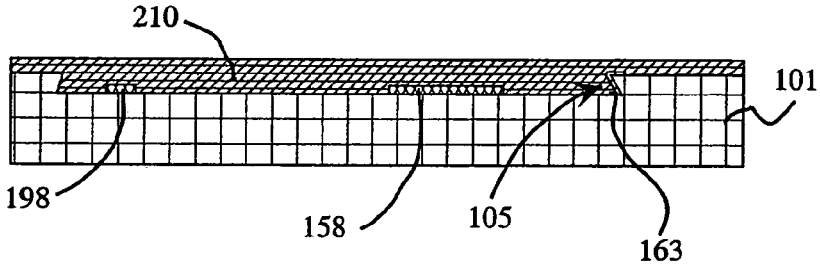

Next, as shown in FIG. 7D, a support layer 210 is placed on top of the deposited metal and the substrate 101 including the etched region 103. The support layer 210 typically comprises $SiO_2$, which may be sputter deposited or deposited using PECVD (plasma enhanced chemical vapor deposition). The support layer 210 is preferably planarized after being deposited by chemical-mechanical planarizing. Other materials besides $SiO_2$ may be used as a sacrificial layer 210. The important characteristics of the sacrificial layer 210 are a high etch rate, good thickness uniformity, and conformal coating by the oxide of the metal already on the substrate 210. The thickness of the oxide partially determines the thickness of the switch opening, which is critical in determining the voltage necessary to close the switch as well as the electrical isolation of the switch when the switch is open. The sacrificial layer 210 will be removed in the final step to release the switch beam 150 as shown in FIG. 7*h*.

Another advantage of using $SiO_2$ as the support layer 210 is that $SiO_2$ can withstand high temperatures. Other types of support layers, such as organic polyimides, harden considerably if exposed to high temperatures. This makes the polyimide sacrificial layer difficult to later remove. The support layer 210 is exposed to high temperatures when the silicon nitride for the structural layers 151, 152 is deposited, as a high temperature deposition is desired when depositing the silicon nitride to give the silicon nitride a lower HF etch rate.

Figure 7E:
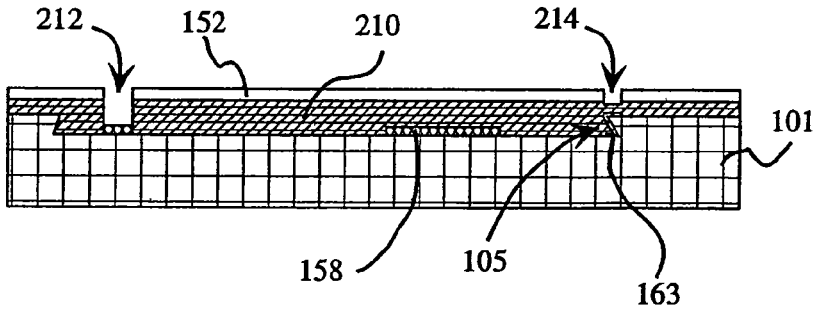

FIG. 7E shows the fabrication of the lower structural layer 152. The lower structural layer 152 and the upper structural layer 151 (discussed below) are the supporting mechanism of the switch beam 150 and are preferably made out of silicon nitride, although other materials besides silicon nitride may be used. Silicon nitride is preferred because it can be deposited so that there is neutral stress in the structural layers 151, 152. Neutral stress fabrication reduces the bowing that may occur when the switch is actuated. The material used for the structural layers 151, 152 must have a low etch rate compared to the support layer 210 so that the structural layers 151, 152 are not etched away when the support layer 210 is removed to release the switch beam 150.

FIG. 7E also shows the etching of the structural layer 152 and the support layer 210 to form recesses 212 for vias for the interdigitated fingers 181 and to provide the comb actuator posts 188. Those skilled in the art will understand that recesses may also be formed at this step in the process for the switch beam anchors 175 and for vias to provide electrical contact to the other side of the interdigitated fingers 181. However, these other recesses are not shown in FIG. 7E, due to the cross-section depicted. The structural layer 151 and the support layer 210 may also be etched at this time to form a recess 214 into which metal for the tip 161 will be deposited. The structural layer 152 and the support layer 210 are patterned and etched using standard lithographic and etching processes.

Figure 7F:
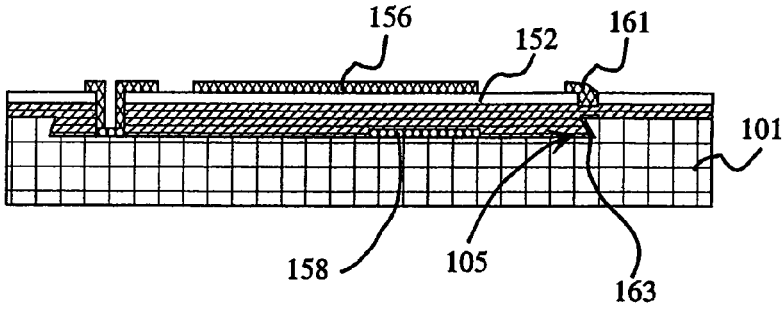

As shown in FIG. 7F, another metal layer 153 is deposited onto the structural layer 152 and into the recesses 212, 214. This second metal layer forms the beam electrode 158. Metal deposited in this step may also form the tip 161 and portions of the interdigitated fingers 181. In the preferred embodiment, the second metal layer is comprised of a sputter deposition of a thin film (200 angstroms) of Ti followed by a 1000 angstrom deposition of Au. The second metal layer should be conformal across the wafer and acts as a plating plane for the Au. The plating is done by using metal lithography to open up the areas of the switch that are to be plated. The Au is electroplated by electrically contacting the membrane metal on the edge of the wafer and placing the metal patterned wafer in the plating solution. The plating occurs only where the membrane metal is exposed to the plating solution to complete the electrical circuit and not where the electrically insulating resist is left on the wafer. After 2 microns of Au is plated, the resist is stripped off of the wafer and the whole surface is ion milled to remove the membrane metal. Some Au will also be removed from the top of the plated Au during the ion milling, but that loss is minimal because the membrane is only 1200 angstroms thick.

Figure 7G:
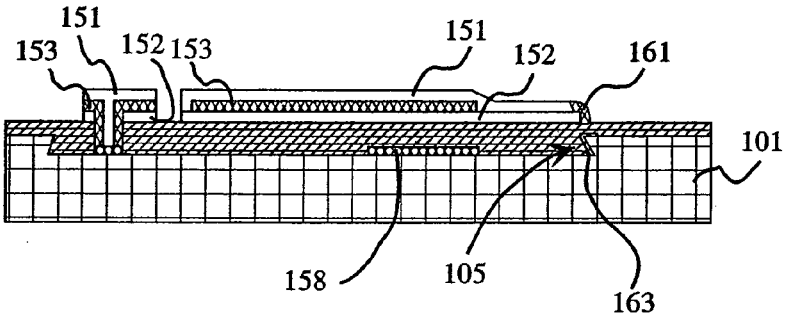
Figure 7H:
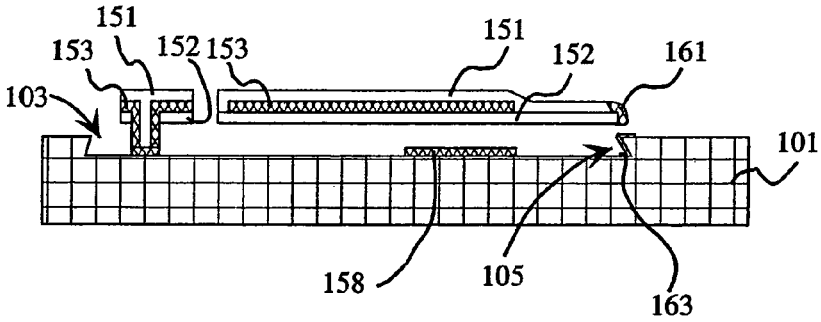

FIG. 7G shows the deposition of the second structural layer 151. As shown, the second structural layer 151 covers the second metal layer 153 in the area of the beam electrode 156 and also fills in additional portions of the recess 212 to form the comb actuator posts 188. The second structural layer 152 may also be deposited at this time to form the switch beam anchors 175 (not shown in FIG. 7G). The second structural layer 151 is then lithographically defined and etched to complete the formation of the switch beam spring 170 and the comb-drive actuators. Finally, as shown in FIG. 7H, the support layer 210 is removed to release the switch beam 150.

If the support layer 210 comprises of $SiO_2$, then it will typically be wet etched away in the final fabrication sequence by using a hydrofluoric acid (HF) solution. The etch and rinses are preferably performed with post-processing in a critical point dryer to ensure that the switch beam 150 does not come into contact with the substrate 101 when the support layer 210 is removed. If contact occurs during this process, device sticking and switch failure are likely. Contact is prevented by transferring the switch from a liquid phase (e.g. HF) environment to a gaseous phase (e.g. air) environment not directly, but by introducing a supercritical phase in between the liquid and gaseous phases. The sample is etched in HF and rinsed with DI water by dilution, so that the switch is not removed from a liquid during the process. DI water is similarly replaced with ethanol. The sample is transferred to the critical point dryer and the chamber is sealed. High pressure liquid $CO_2$ replaces the ethanol in the chamber, so that there is only $CO_2$ surrounding the sample. The chamber is heated so that the $CO_2$ changes into the supercritical phase. Pressure is then released so that the $CO_2$ changes into the gaseous phase. Now that the sample is surrounded only by gas, it may be removed from the chamber into room air.

The fabrication of an alternative embodiment according to the present invention is depicted in FIGS. 8A-8D. As indicated above, it is preferred that the fingers of the interdigitated fingers 181 have a thickness of at least 5 μm so that the lateral electrostatic voltage $V_L$ is kept to around 50V or less. However, as discussed above and shown in FIG. 7F, the metal for the interdigitated finger 181 can be deposited at the same time as the metal for the beam electrode 156. If the metal layer for the beam electrode 156 is 5 μm, the switch beam will become thicker and may become stiffer and more difficult to pull down. Hence, the process shown in FIGS. 7A-7H, may require one to choose between a lower lateral electrostatic voltage $V_L$ and a higher transition voltage $V_T$ between the beam electrode 156 and the substrate electrode 158, or a higher lateral electrostatic voltage $V_L$ and a lower transition voltage $V_T$. FIGS. 8A-8D depict the fabrication of an embodiment in which the interdigitated fingers 181 may have a different thickness than the beam electrode 156.

Figure 8A:
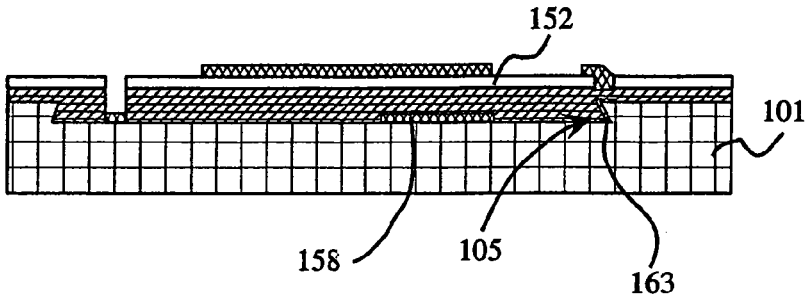
FIGS. 8A-8D show steps of a fabrication process of an alternative embodiment according to the present invention.
Figure 8B:
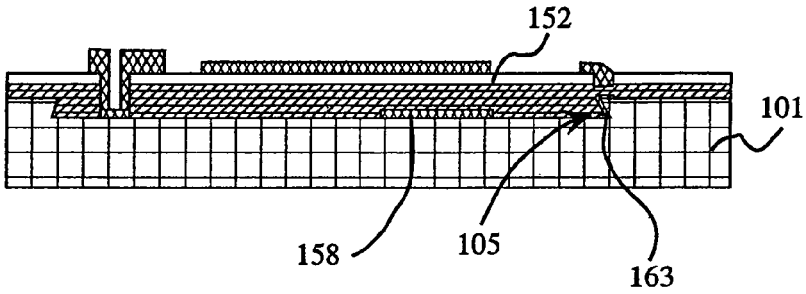
Figure 8C:
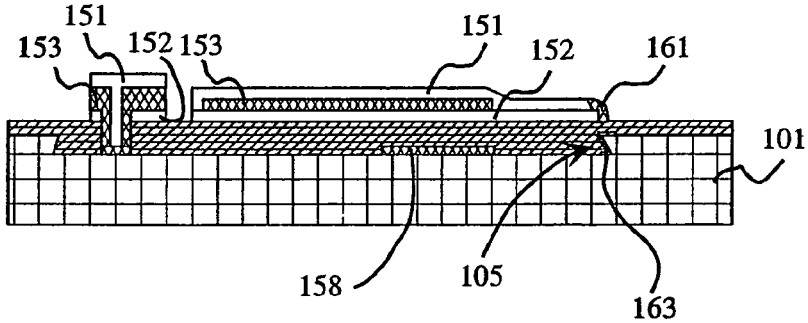
Figure 8D:
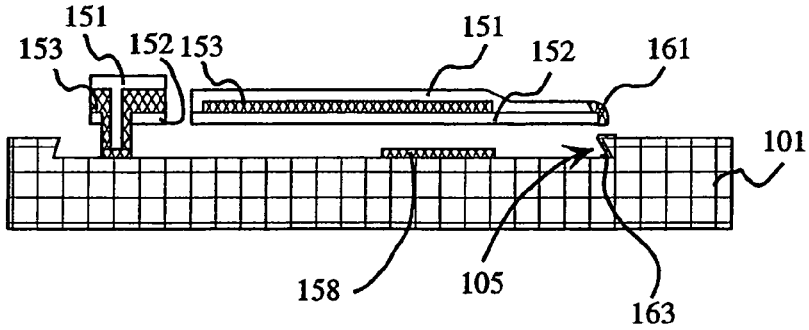

FIG. 8A depicts a process step similar to that shown in FIG. 7F, in which metal is deposited to form the beam electrode 156 and the tip 161. However, in this step, the metal for the interdigitated fingers is not yet deposited. FIG. 8B depicts another metal deposition step, in which the gold (or other electrically conductive material) for the interdigitated fingers is deposited with a metal layer thicker than that used to form the beam electrode 156. As discussed above, a preferred thickness for the interdigitated fingers is 5 μm. FIGS. 8C and 8D depict process steps similar to those depicted in FIGS. 7G and 7H, in which the upper structural layer 151 is deposited and patterned and the support layer 210 is removed to release the switch beam 150. As shown in FIG. 8D, the metal layer 153 for the interdigitated finger 181 is thicker than the metal layer 153 for the beam electrode 156.

As can be surmised by one skilled in the art, there are many more configurations of the present invention that may be used other than the ones presented herein. It is therefore intended that the foregoing detailed description be regarded as illustrative rather than limiting and that it be understood that it is the following claims, including all equivalents, that are intended to define the scope of this invention.

What is claimed is:

1. A micro-electro-mechanical switch comprising a substrate, wherein the substrate has at least one recess with a tip receiving structure;

a cantilever structure disposed on the substrate, wherein the cantilever structure has a cantilever structure tip adapted to fit into the tip receiving structure;

a horizontal actuator having a cantilever horizontal actuator portion coupled to the cantilever structure and a substrate horizontal actuator portion disposed on the substrate; and a vertical actuator having a cantilever vertical actuator portion disposed on the cantilever structure and a substrate vertical actuator portion disposed on the substrate.

2. The micro-electro-mechanical switch of claim 1, wherein the cantilever structure comprises:

a switch beam spring disposed on the substrate; and a switch beam coupled to the switch beam spring, wherein the switch beam spring is configured to allow the switch beam to move in a direction generally parallel to the substrate.

3. The micro-electro-mechanical switch of claim 2, wherein the horizontal actuator comprises:

a comb-drive actuator having a plurality of pairs of interdigitated electrode fingers, wherein each pair of interdigitated electrode fingers has a substrate actuator finger and a cantilever actuator finger, and the substrate horizontal actuator portion comprises:

one or more comb actuator posts disposed on the substrate, and the substrate actuator fingers, wherein each substrate actuator finger extends from one of the one or more comb actuator posts, and the cantilever horizontal actuator portion comprises:

the cantilever actuator fingers, wherein each cantilever actuator finger extends from the switch beam spring.

4. The micro-electro-mechanical switch of claim 1 wherein the tip receiving structure comprises a transition between the at least one recess and an upper surface of the substrate, wherein the upper surface of the substrate projects over an upper surface of the at least one recess at the transition, and the switch further comprises:

an input line;

an output line;

an input mortise electrically connected to the input line, wherein the input mortise comprises conducting material disposed on a portion of the transition between the at least one recess and the upper surface of the substrate;

an output mortise electrically connected to the output line, wherein the output mortise comprises conducting material disposed on a portion of the transition between the at least one recess and the upper surface of the substrate, wherein the input mortise is separated from the output mortise by a gap with no conducting material in the transition between the at least one recess and the upper surface of the substrate, and the cantilever structure tip comprises conducting material sized to span the gap and electrically connect the input mortise to the output mortise.

5. The micro-electro-mechanical switch of claim 2, wherein the cantilever vertical actuator portion comprises a switch beam electrode disposed on the switch beam and the substrate vertical actuator portion comprises a substrate electrode disposed to attract the switch beam electrode towards the substrate when a voltage is applied between the switch beam electrode and the substrate electrode.

6. The micro-electro-mechanical switch of claim 5, wherein the switch beam comprises one or more upper switch beam layers and one or more lower switch beam layers and the switch beam electrode is disposed between one or more upper switch beam layers and the one or more lower switch beam layers.

7. The micro-electro-mechanical switch of claim 6, wherein the upper switch beam layers and/or the lower switch beam layers comprise silicon nitride.

8. The micro-electro-mechanical switch of claim 5, wherein the switch beam electrode and/or the substrate electrode comprise gold.

9. The micro-electro-mechanical switch of claim 1, wherein the substrate comprises GaAs with a {100} crystallographic orientation.

10. The micro-electro-mechanical switch of claim 2, wherein the switch beam spring comprises one or more layers of silicon nitride.

11. A method of switching comprising:

providing a cantilever structure coupled to a substrate by a spring structure, wherein the cantilever structure has at least a portion of the cantilever structure adapted to move generally parallel to a surface of the substrate and move generally perpendicular to the surface of the substrate;

applying a first voltage to move the at least a portion of the cantilever structure in a first direction parallel to the surface of the substrate by a first electrostatic attractive force;

after applying the first voltage, applying a second voltage to attract the at least a portion of the cantilever structure towards the surface of the substrate by a second electrostatic attractive force;

after applying the second voltage, removing the first voltage and having the at least a portion of the cantilever structure move in a direction generally opposite to the first direction due to a horizontal spring force from the spring structure; and after removing the first voltage, capturing a tip of the cantilever structure in a receiving structure provided in or on the substrate.

12. The method of claim 11, wherein the spring structure comprises a horizontal spring portion and a vertical spring portion, the horizontal spring portion applying the horizontal spring force in a direction opposite to the first electrostatic attractive force and the vertical spring portion applying a vertical spring force is a direction opposite the second electrostatic attractive force.

13. The method of claim 11 further comprising:

removing the second voltage, wherein the cantilever structure is held in place by the tip captured in the receiving structure.

14. The method of claim 13 further comprising:

after capturing the tip of the cantilever structure in a receiving structure provided in or on the substrate, applying a third voltage to move the at least a portion of the cantilever structure in the first direction parallel to the surface of the substrate by a third electrostatic attractive force; and removing the second voltage either before or after applying the third voltage.

15. The method of claim 11, wherein the tip of the cantilever structure comprises electrically conducting material and the receiving structure comprises: an input conducting material portion, an output conducting material portion, and a nonconducting gap disposed between the input conducting material portion and the output conducting material portion, and the tip of the cantilever structure spans the nonconducting gap to provide an electrical connection between the input conducting material portion and the output conducting material portion when the tip of the cantilever structure is captured in the receiving structure.

16. A micro-electro-mechanical switch comprising a substrate;

a cantilever structure coupled to the substrate, the cantilever structure having a first end and a second end;

means for providing movement in a first vertical direction of the second end of the cantilever structure, the means for providing movement in a first vertical direction disposed at or near the first end of the cantilever structure;

means for providing movement in a first horizontal direction of the second end of the cantilever structure, the means for providing movement in a first horizontal direction disposed at or near the first end of the cantilever structure;

means for providing movement in a second vertical direction of the second end of the cantilever structure, the second vertical direction opposite to the first vertical direction;

means for providing movement in a second horizontal direction of the second end of the cantilever structure, the second horizontal direction opposite to the first horizontal direction; and means for capturing the second end of the cantilever structure when the second end of the cantilever structure is moved towards the substrate.

17. The micro-electro-mechanical switch of claim 16 further comprising switch conductive means disposed on the second end of the cantilever structure and the means for capturing further comprises an input conductive means, an output conductive means, and a nonconductive means separating the input conductive means and the output conductive means, wherein the switch conductive means electrically connects the input conductive means to the output conductive means when the second end is captured in the means for capturing.

* * * * *